US009038806B2

(12) United States Patent
Mäkimattila

(10) Patent No.: US 9,038,806 B2
(45) Date of Patent: May 26, 2015

(54) TRUSS DEVICE AND AN ESCALATOR OR MOVING WALK

(71) Applicant: Simo Mäkimattila, Shanghai (CN)

(72) Inventor: Simo Mäkimattila, Shanghai (CN)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 14/292,004

(22) Filed: May 30, 2014

(65) Prior Publication Data

US 2014/0360836 A1 Dec. 11, 2014

(30) Foreign Application Priority Data

Jun. 7, 2013 (CN) ..... 2013 1 0225926

(51) Int. Cl.
*B66B 23/00* (2006.01)
*B66B 23/14* (2006.01)
*B66B 21/02* (2006.01)

(52) U.S. Cl.
CPC ..... *B66B 23/00* (2013.01); *B66B 23/14* (2013.01); *B66B 21/02* (2013.01)

(58) Field of Classification Search
CPC ..... B66B 23/00; B66B 23/14; B66B 21/02
USPC ..... 198/321–338
See application file for complete search history.

(56) References Cited

U.S. PATENT DOCUMENTS 4,179,020 A * 12/1979 Heusler et al. ..... 198/326
5,215,177 A * 6/1993 Johnson et al. ..... 198/335
5,421,076 A * 6/1995 Adrian et al. ..... 29/467
7,234,583 B2 * 6/2007 Illedits et al. ..... 198/324
7,426,989 B2 * 9/2008 Krampl ..... 198/321
7,703,594 B2 * 4/2010 Stein ..... 198/321
7,980,379 B2 * 7/2011 Winkler ..... 198/327
8,919,527 B2 * 12/2014 Heinemann et al. ..... 198/321
2002/0175039 A1 11/2002 Fargo et al.
2003/0000800 A1 * 1/2003 Krampl ..... 198/321
2005/0108974 A1 * 5/2005 Lauch ..... 52/633

FOREIGN PATENT DOCUMENTS

CN 103043519 A 4/2013
JP 2003-335486 A 11/2003

OTHER PUBLICATIONS

European Search Report dated Sep. 25, 2014 issued in corresponding European Application No. 14167654.4.

* cited by examiner

*Primary Examiner* — Mark A Deuble
(74) *Attorney, Agent, or Firm* — Harness, Dickey & Pierce, P.L.C.

(57) ABSTRACT

The present invention provides a truss device for an escalator or moving walk comprising an outer panel and an inner panel facing the outer panel, characterized in that, the inner panel is formed from a single integral panel and comprises a body part and a plurality of connection parts extending from the body part toward the outer panel thus forming corresponding through openings in the inner panel, each connection part is connected to the outer panel so that the outer panel and the inner panel are fixed together, wherein the inner panel further comprises a support part formed on the body part of the inner panel and projecting in a direction away from the outer panel. The present invention also provides an escalator or moving walk having the above truss device.

15 Claims, 4 Drawing Sheets

TRUSS DEVICE AND AN ESCALATOR OR MOVING WALK

This application claims priority to Chinese Patent Application No. CN 201310225926.6 which has a filing date of Jun. 7, 2013, the entire contents of which are incorporated herein by reference.

TECHNICAL FIELD

The present invention relates to a truss device, particularly, a truss device for an escalator or moving walk. The present invention also relates to an escalator or moving walk.

BACKGROUND

A truss device of an escalator or moving walk is a supporting member of an escalator or moving walk, mainly for supporting the functional components like a balustrade or steps of the escalator or moving walk. A truss device generally comprises frame structures at the left and right sides of the escalator or moving walk and soffit sections connecting the left and right frame structures. For some truss device, it may not comprise the soffit sections, and in this case, the truss device means the frame structures at the left and right sides of the escalator or moving walk. Traditionally, the frame structure of the truss device is formed for example by a plurality of angle steel beams welded together which comprises an upper beam and a lower beam extending in the moving direction of the escalator or moving walk, and crossing beams crossing between the upper beam and the lower beam. Such a truss device has its advantage in aspect of load supporting. However it has a disadvantage of high weight and large material cost since it is composed of a plurality of angle steel beams. In addition, for the sake of safety, at least the outer side of the truss device, i.e. the outer side of the escalator or moving walk, is needed to be fitted with decorative panel to wrap the whole truss device to prevent the passengers of the escalator or moving walk touching the inside of the truss device, which makes the weight of the truss device higher and its configuration more complex.

In recent years, a load-supporting device as such is suggested: the load-supporting device is composed of two panels, rather than a plurality of angle steel beams. Particularly, the load-supporting device comprises an outer panel and an inner panel facing the outer panel. The outer and inner panels are connected with each other by connecting means. Such a load-supporting device has its improvements in aspect of reducing the overall weight of the device. However, its capability of load supporting is not sufficient. Thus, there is no report that such a load-supporting device is applied as a truss device of an escalator or moving walk. In addition, if such a load-supporting device is applied as a truss device of an escalator or moving walk, because the load-supporting device is composed of two panels with flat surfaces, then it is not easy to install other functional components on the load-supporting device, that is, it becomes necessary to additionally provide some new components, for example, to weld some supporting components onto the inner panel to support the steps and so on of the escalator or moving walk, which makes the overall structure more complex.

Thus, there exists a need of providing a truss device for an escalator or moving walk, which is light but still has sufficient load-supporting capacity.

INVENTION SUMMARY

In view of the disadvantages and problems as mentioned above in the prior arts, the purpose of the present invention is to at least solve some of them.

According to a preferred embodiment of the present invention, a truss device for an escalator or moving walk is provided, which comprises an outer panel and an inner panel facing the outer panel, wherein the inner panel is formed from a single integral panel and comprises a body part and a plurality of connection parts extending from the body part toward the outer panel thus forming corresponding through openings in the inner panel, each connection part is connected to the outer panel so that the outer panel and the inner panel are fixed together, wherein the inner panel further comprises a support part formed on the body part of the inner panel and projecting in a direction away from the outer panel. With this, on one hand, since the truss device is formed by two panels and one of the panels has through openings therein, compared with the traditional truss device composed of angle steel beams, the truss device according to the present invention has light weight. Further, the outer panel may directly used as an outer decorative panel, eliminating the need of adding an extra decorative panel in the prior art and thus further reducing the weight of the truss device. Still further, since a support part is directly formed on the inner panel and the support part may be designed according to the functional components of the escalator or moving walk to be supported, the need of for example welding additional supporting components on the inner panel according to the prior art is eliminated, which enables the further reduce of the overall weight. In addition, the support part integral with the inner panel has its advantageous on the structure strength. Therefore, the truss device according to the present invention is not only weight-light, but also fully meets the requirement of load supporting.

In the preferred embodiment of the present invention as above, preferably, the support part is formed as a guide of rollers of the steps and the chains of the escalator or moving walk. With this, the truss device itself is formed with a guide, therefore, it is not necessary to provide an additional guide for the escalator or moving walk.

In any of the preferred embodiments of the present invention as above, preferably, the support part is straight or curved. With this, the truss device may meet different requirements. For example, the straight support part may be used as the straight guide of rollers of the steps and the chains of the escalator or moving walk, whereas the curved support part may be used as the curved guide of rollers of the steps and the chains of the escalator or moving walk.

In any of the preferred embodiments of the present invention as above, preferably, the connection part is connected to the outer panel by welding. With this, the inner panel and the outer panel are easily and securely fixed with each other to improve the overall stiffness.

In any of the preferred embodiments of the present invention as above, preferably, the truss device further comprises a profile member sandwiched between, or sandwiching, an edge part of the inner panel and an edge part of the outer panel. With this, on one hand, since a profile member is disposed between an edge part of the inner panel and an edge part of the outer panel, the stiffness at the edges of the truss device is improved and thus the load-supporting capability of the whole truss device is improved, and on the other hand, the profile member may also be used as for example a supporting member for the balustrade of the escalator or moving walk.

In any of the preferred embodiments of the present invention as above, preferably, the profile member is welded to the inner panel and the outer panel. With this, the inner and outer panels may be easily connected together at the edges.

In any of the preferred embodiments of the present invention as above, preferably, the profile member is a H-shape profile member or C-shape profile member. With this, since a H-shape profile member or C-shape profile member is very common, the material choosing of the truss device is easy, which facilitates the reduce of the material cost.

In any of the preferred embodiments of the present invention as above, preferably, the connection part is shaped by cutting an integral panel along a predetermined cutting line and then bending it along a predetermined bending line. With this, the inner panel is easily formed from an integral panel and the bended parts are directly used as the connection part, thus the whole manufacturing process is simple and there is no material waste in the manufacturing process. In addition, the inner panel is formed with through openings at the place of the connection part bended, which enables a light truss device.

In any of the preferred embodiments of the present invention as above, preferably, the cutting line is a diagonal line of a rectangle, and the bending line is a side of the rectangle. With this, four adjacent connection parts respectively extending from the four sides of the rectangle are formed at each rectangle. The four connection parts are in the different planes respectively, which makes the whole truss device have good stiffness in each direction, improving the load-supporting capacity of the whole truss device.

In any of the preferred embodiments of the present invention as above, preferably, the cutting line is three sides of a rectangle, and the bending line is the other side of the rectangle. With this, one connection part is formed at each rectangle. For each rectangle, a different side may be formed as the bending line. For example, the lower side of one rectangle may be used as the bending line, the upper side of the next adjacent rectangle may be used as the bending line, and the left side of the next adjacent rectangle may be used as the bending line, and so on, then connection parts on the different planes may be achieved, which makes the whole truss devices have good stiffness in every direction.

In any of the preferred embodiments of the present invention as above, preferably, each connection part comprises a load-supporting part extending out from the bending line and a joining part bended relative to the load-supporting part as parallel to the outer panel and joined to the outer panel. With this, since the joining part is parallel to the outer panel, it may have large joining surface area with the outer panel, which may facilitates securely connecting the inner panel to the outer panel and thus improving the stiffness of the whole truss device.

In any of the preferred embodiments of the present invention as above, preferably, the load-supporting part is perpendicular to the body part of the inner panel. With this, since the load-supporting part is perpendicular to the body part of the inner panel, that is, the load-supporting part is perpendicular to the inner panel and the outer panel, the truss device has good compressive strength in the direction perpendicular to the inner panel and the outer panel.

In any of the preferred embodiments of the present invention as above, preferably, the outer panel is formed from a single integral smooth panel. With this, the smooth outer panel may also be used as the decorative panel.

In any of the preferred embodiments of the present invention as above, preferably, the outer panel or the inner panel is formed from hot-rolled steel or cold-rolled steel.

According to a preferred embodiment of the present invention, an escalator or moving walk is also provided, which comprises the truss device according to any of the preferred embodiments of the present invention as above.

It should be understood that the description above is just for illustration purposes and is not intended to limit the scope of the present invention.

DESCRIPTION TO DRAWINGS

The above and other features and advantages of the illustrative embodiments of the present invention will become apparent from the description in detail in connection with the accompanying drawings, and the description and the figures are just for illustration purposes and are not intended to limit the scope of the present invention in any way, wherein.

DETAILED DESCRIPTION TO EMBODIMENTS

In the following, some exemplary embodiments of the present invention will be described referring to the accompanying drawings.

The above and other technical features, properties and effects of the present invention will become apparent in the following detailed description to the embodiments in connection to the accompanying drawings. The directional terms like upper, lower, left, right, front, back etc, used in the description are just directions referring to the accompanying drawings. Thus, such terms are just for illustrative purpose and are not used to limit the present invention. In addition, in all the embodiments, like reference numbers refer to like elements.

First, it shall be understood that, an escalator or moving walk mentioned in the present application means not only an escalator/elevator device moving in a horizontal direction but also an escalator/elevator device moving in an oblique direction relative to the horizontal direction, and the latter comprises an escalator/elevator device wherein the surface of each step of the escalator/elevator device is in the horizontal plane but one step is higher than the adjacent step, and an escalator/elevator device wherein the surface of each step is oblique and thus the steps together form an oblique ramp for the standing of the passengers.

Figure 1:
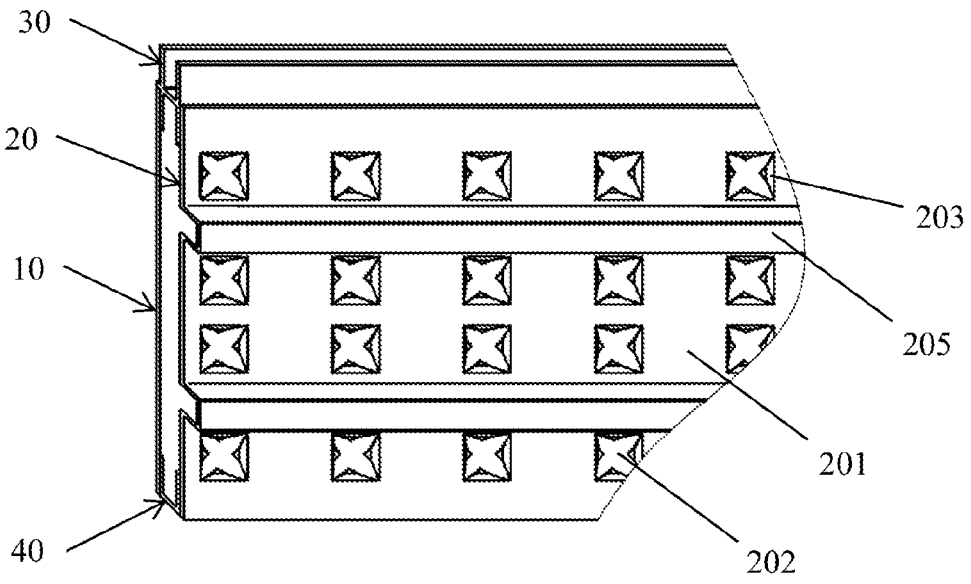
FIG. 1 is a three-dimensional view of a truss device according to an embodiment of the present invention.

Refer to FIG. 1 which is a three-dimensional view of a truss device according to an embodiment of the present invention, a truss device for an escalator or moving walk according to this embodiment comprises an outer panel 10, an inner panel 20 facing the outer panel 10, a H-shape profile member 30 sandwiched between an upper edge part of the inner panel and an upper edge part of the outer panel (particularly, in some other embodiments, the profile member may sandwich the edge part of the inner panel and the edge part of the outer panel), and a C-shape profile member 40 sandwiched between a lower edge part of the inner panel and a lower edge part of the outer panel. The inner panel 20 is formed from a single integral panel and comprises a body part 201 and a plurality of connection parts 203 extending from the body part 201 toward the outer panel 10 thus forming corresponding through openings 202 in the inner panel 20. Each connection part 203 is connected to the outer panel 10 so that the outer panel 10 and the inner panel 20 are fixed together. The inner panel 20 further comprises a support part 205 formed on the body part 201 of the inner panel 20 and projecting in a direction away from the outer panel 10. The outer panel 10 is formed from a single integral smooth panel, thus it may be also used as a decorative panel, omitting the additional decorative panel added onto the outer panel in the prior art. The profile members 30, 40 may be connected to the inner and outer panels by welding.

As shown in FIG. 1, the support part 205 of the inner panel 20 is formed as a continuous straight component, and thus may be used as for example but not limited to a guide of rollers of the steps and the chains of the escalator or moving walk. Of course, if needed, the support part 205 may also be formed as a continuous curved component (see FIG. 7). The inner panel 20 may be formed from for example but not limited to hot-rolled steel or cold-rolled steel. Particularly, the inner panel may be formed from high-strength low-carbon cold-rolled steel, hot-dip and electro-galvanized zinc coated cold-rolled steel, formable low-carbon steel, or high-strength hot-rolled steel, etc., and its thickness may be for example 4-5 mm depending on the load-supporting requirement needed. Since the inner panel is formed form rolled steel, the support part may be easily formed by rolling a panel blank. The outer panel 10 may be from a material same with that of the inner panel.

Figure 2:
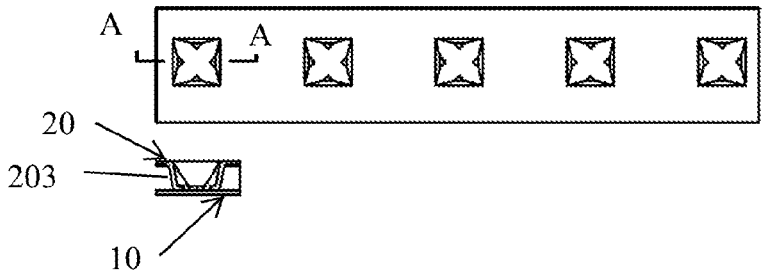
FIG. 2 is a partial view of the truss device as shown in the FIG. 1.
Figure 3:
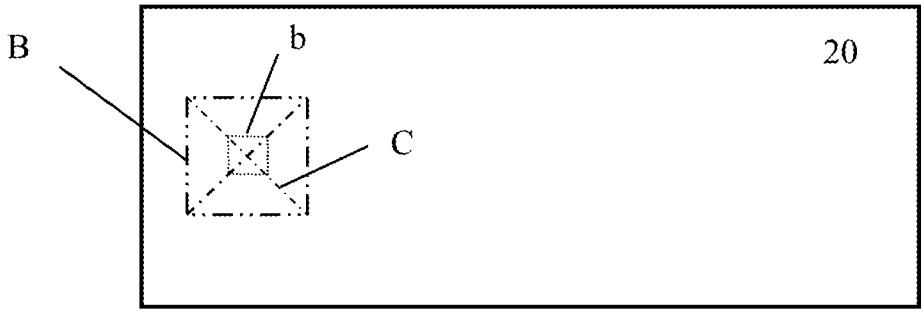
FIG. 3 is a view showing how to form the connection part of the truss device as shown in FIG. 1.
Figure 4:
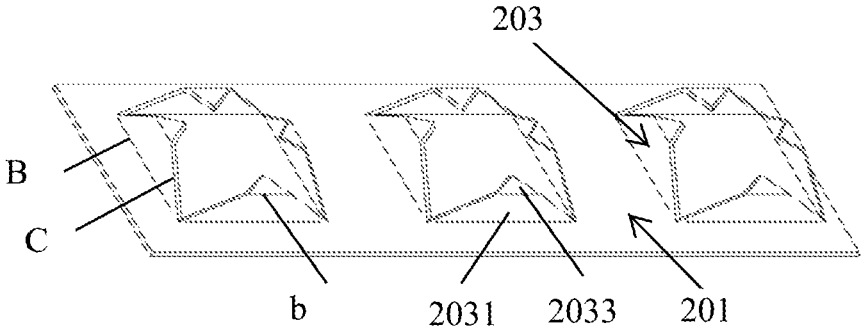
FIG. 4 is a partial three-dimensional view of the inner panel of the truss device as shown in FIG. 1.

Below refer to FIGS. 2-4 to describe how to form the connection part of the truss device as shown in FIG. 1, wherein FIG. 2 is a partial view of the truss device as shown in the FIG. 1, and the upper drawing of FIG. 2 is a partial planar view of the truss device as shown in FIG. 1 and the lower drawing of FIG. 2 is a sectional view along Line A-A of the upper drawing of FIG. 2; FIG. 3 is a view showing how to form the connection part of the truss device as shown in FIG. 1; FIG. 4 is a partial three-dimensional view of the inner panel of the truss device as shown in FIG. 1.

Refer to FIG. 2, the outer panel 10 and the inner panel 20 face with each other and the connection part 203 of the inner panel connects the inner panel to the outer panel and thus makes the inner and outer panels be fixed together. Preferably, the connection part 203 may be connected to the outer panel 10 by welding. Of course, the connection way in the present invention is not limited to welding, and other ways like gluing, connecting through bolts, riveting, shape-fitting like snapping, etc, are also suitable, as long as the inner and outer panels may be securely fixed together.

Refer to FIG. 3 which illustrates how to form the connection part of the truss device. First, a flat and smooth integral panel 20 is cut along a predetermined cross cutting line C to form four triangles partially separated from the panel 20. Then, the four triangles are bended/flexed outward for example 90 degrees along a predetermined bending line B. Then or at the same time, the triangles are further bended along the bending line b. Thus, the connection parts 203 as shown in FIG. 4 may be obtained.

In the process of forming connection parts as shown in FIG. 3, the adjacent four bending lines B form a rectangle, like square, and the cutting line is the diagonal line of the rectangle, thus, four regular connection parts perpendicular to each other may be formed easily and quickly. Since the connection parts are respectively distributed in four planes perpendicular to each other, the four connection parts together may provide good stiffness and strengthen in four directions/planes. Therefore, the inner and outer panels as a whole connected by such connection parts may have good strength in each directions, and thus the truss device may have good load-supporting capability.

Figure 5:
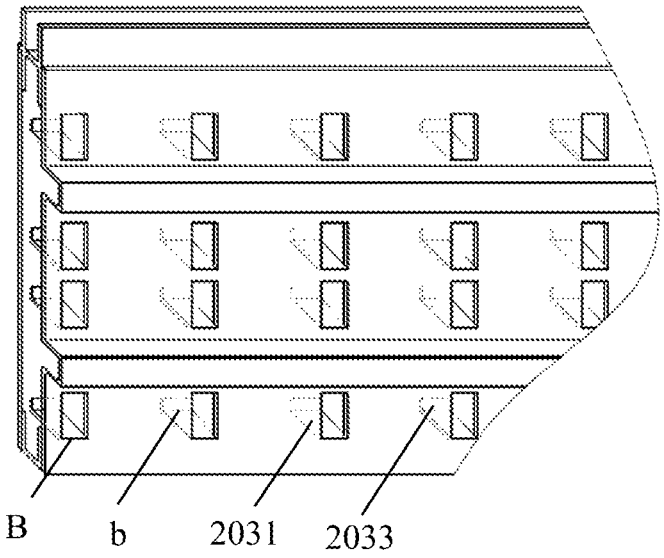
FIG. 5 is a three-dimensional view of a truss device according to another embodiment of the present invention.

Of course, the shape and structure of the connection parts of the present invention is not limited to that as shown in FIG. 4. For example, the connection parts of the present invention may be formed as that shown in FIG. 5 with substantially rectangular shape. Refer to FIG. 5, the cutting line is three sides of a rectangle, and the bending line B is the other side of the rectangle.

In the process of forming the connection part from a panel blank, the length of the cutting line may be varied to change the size of the connection part. For example, in FIG. 3, the diagonal line may become longer, that is, the rectangle area formed through the bending line B will become bigger, and a bigger/longer connection part may be obtained.

Refer to FIG. 4, each connection part 203 comprises a load-supporting part 2031 extending out from the bending line B and a joining part 2033 bended relative to the load-supporting part 2031 as parallel to the outer panel and joined to the outer panel (refer to FIG. 2 also). Preferably, the load-supporting part 2031 is substantially perpendicular to the body part 201 of the inner panel 20. It should be noted that the angle of the load-supporting part relative to the body part of the inner panel is not limited to 90 degrees, but it may be other degrees. In addition, the positions/orientations of the connection parts relative to each other may be not as shown in the figures. For example, the three groups of connection parts (each group comprises four connection parts) as shown in the FIG. 4 may be set as in different orientations. Particularly, for example, the middle group of connection parts may be rotated by 45 degrees in anti-clock direction, that is, the rectangular bending lines of the middle group are rotated by 45 degrees in the plane of the part body 201 relative to the left group, therefore, a plurality of groups of connection parts with different orientations my be formed so that the truss device may have good load-supporting capability in each direction.

Refer to FIG. 5 which is a three-dimensional view of a truss device according to another embodiment of the present invention, the main difference between the truss device according to the embodiment of FIG. 5 and the truss device according to the embodiment of FIG. 1 is the difference of the shape of the connection part. Particularly, the connection part of the truss device according to the embodiment of FIG. 5 has a rectangular shape. Such connection parts with rectangular shape may be obtained by cutting along the three sides (the cutting line) of the rectangle to get a connection part which is connected with the body part of the inner panel only at the other side B of the rectangle; then by bending at the side B, and bending at the other bending line b parallel to the bending line B, to form a load-supporting part 2031 sandwiched between the inner and outer panels and a joining part 2033 parallel to the outer panel and joined to the outer panel.

Figure 6:
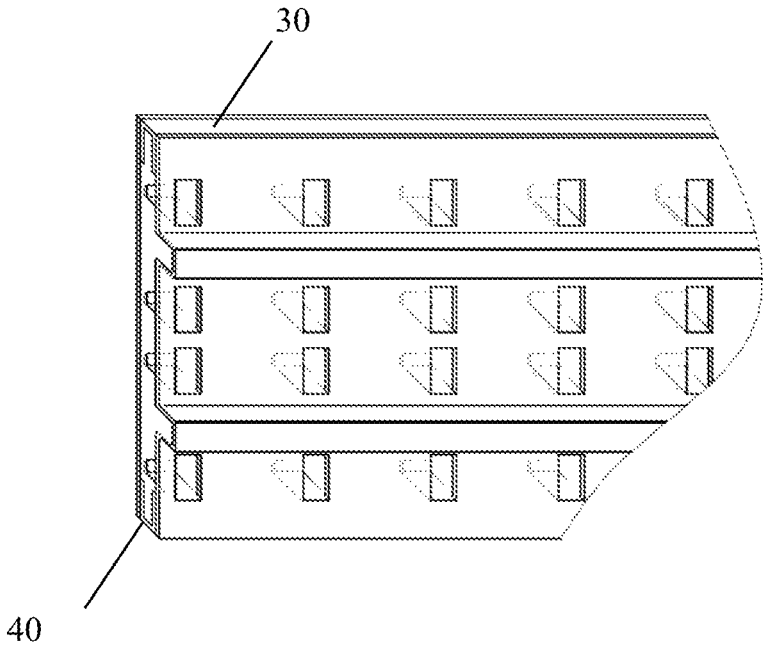
FIG. 6 is a three-dimensional view of a truss device according to still another embodiment of the present invention.

Refer to FIG. 6 which is a three-dimensional view of a truss device according to still another embodiment of the present invention, the main difference between the truss device according to the embodiment of FIG. 6 and the truss device according to the embodiment of FIG. 5 lies in that: in the embodiment of FIG. 5, a H-shape profile member at the upper edge of the truss device is adopted to improve the strength of the upper edges of the inner and outer panels, and a C-shape profile member at the lower edge of the truss device is adopted to improve the strength of the lower edges of the inner and outer panels; whereas in the embodiment of FIG. 6, C-shape profile members are adopted at both the upper and the lower edges of the truss device. It should be understood that the term "C-shape" used in the present application means generally C shape. Particularly, as shown in FIG. 6, in order to better fit with the inner and outer panels, the upper and lower part of "C" has become straight, that is, a generally C shape is formed as a rectangle lacking one side.

Figure 7:
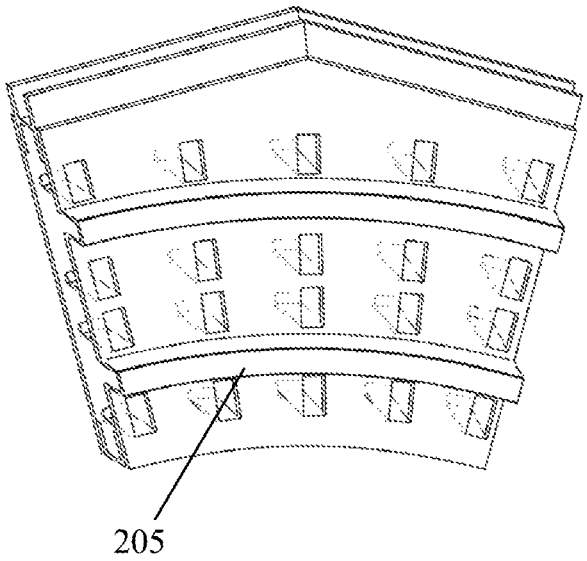
FIG. 7 is a three-dimensional view of a truss device according to a still further embodiment of the present invention.

Refer to FIG. 7 which is a three-dimensional view of a truss device according to still further embodiment of the present invention, the main difference between the truss device according to the embodiment of FIG. 7 and the truss device according to the embodiment of FIG. 5 lies in that: in the embodiment of FIG. 5, the supporting part 205 is formed as straight, whereas in the embodiment of FIG. 7, the supporting part 205 is formed as curved.

It shall be noted that one of the purposes of the embodiments presented in FIGS. 5-7 is to give some different examples of the connection part and the profile member between the edges of the inner and outer panels, to indicate that within the inventive concept of the present invention the shapes and structures of such components may be varied. Therefore, the present invention is not limited to the particular forms shown in the figures.

Accordingly, the present invention also provides an escalator or moving walk comprising a truss device as described above.

While the disclosure has been described in the specification and illustrated in the drawings with reference to various embodiments, it will be understood by those skilled in the art that the embodiments as above are just for illustrative purpose, and some features of the embodiment may be not essential or necessary to solve a given technical problem and thus said features may be eliminated or omitted without substantial impact to the solution to the technical problem. What's more, the features, elements and/or functions of one embodiment may be incorporated, applied or fitted into another embodiment as appropriate, unless described otherwise above or it is not practicable at all.

The invention claimed is:

1. A truss device for an escalator or moving walk, comprising an outer panel and an inner panel facing the outer panel, wherein, the inner panel is formed from a single integral panel and comprises a body part and a plurality of connection parts extending from the body part toward the outer panel thus forming corresponding through openings in the inner panel, each connection part is connected to the outer panel so that the outer panel and the inner panel are fixed together, wherein the inner panel further comprises a support part formed on the body part of the inner panel and projecting in a direction away from the outer panel.

2. A truss device according to claim 1, wherein, the support part is formed as a guide of rollers of the steps and the chains of the escalator or moving walk.

3. A truss device according to claim 1, wherein, the support part is straight or curved.

4. A truss device according to claim 1, wherein, the connection part is connected to the outer panel by welding.

5. A truss device according to claim 1, wherein, the truss device further comprises a profile member sandwiched between, or sandwiching, an edge part of the inner panel and an edge part of the outer panel.

6. A truss device according to claim 5, wherein, the profile member is welded to the inner panel and the outer panel.

7. A truss device according to claim 5, wherein, the profile member is a H-shape profile member or C-shape profile member.

8. A truss device according to claim 1, wherein, the connection part is shaped by cutting an integral panel along a predetermined cutting line and then bending it along a predetermined bending line.

9. A truss device according to claim 8, wherein, the cutting line is a diagonal line of a rectangle, and the bending line is a side of the rectangle.

10. A truss device according to claim 8, wherein, the cutting line is three sides of a rectangle, and the bending line is the other side of the rectangle.

11. A truss device according to claim 8, wherein, each connection part comprises a load-supporting part extending out from the bending line and a joining part bended relative to the load-supporting part as parallel to the outer panel and joined to the outer panel.

12. A truss device according to claim 11, wherein, the load-supporting part is perpendicular to the body part of the inner panel.

13. A truss device according to claim 1, wherein, the outer panel is formed from a single integral smooth panel.

14. A truss device according to claim 1, wherein, the outer panel or the inner panel is formed from hot-rolled steel or cold-rolled steel.

15. An escalator or moving walk comprising the truss device according to claim 1.

* * * * *